US005199199A

United States Patent [19]

Garfinkle

[11] Patent Number: 5,199,199

[45] Date of Patent: Apr. 6, 1993

[54] SIGN SYSTEM

[76] Inventor: Benjamin L. Garfinkle, 1120 Portal Ave., Piedmont, Calif. 94610

[21] Appl. No.: 647,430

[22] Filed: Jan. 25, 1991

Related U.S. Application Data

[63] Continuation-in-part of Ser. No. 554,146, Jul. 16, 1990.

[51] Int. Cl.[5] ..... G09F 9/00; G09F 3/20

[52] U.S. Cl. ..... 40/5; 40/649; 40/124.4

[58] Field of Search ..... 40/5, 649, 618, 308, 40/359; 281/5, 40, 41; 283/34, 35

[56] References Cited

U.S. PATENT DOCUMENTS

| | | | |
|---|---|---|---|
| 1,288,132 | 12/1918 | Nagle | 281/41 |
| 1,527,382 | 2/1925 | Snyder | 40/5 |
| 1,824,794 | 9/1931 | Rohlfes | 40/5 |
| 2,541,776 | 2/1951 | Murphy | 40/5 |
| 2,626,472 | 1/1953 | Stingl | 40/5 |
| 4,453,324 | 6/1984 | Greenberger | 40/5 |
| 4,477,013 | 10/1984 | Herrin | 40/359 X |
| 4,540,612 | 9/1985 | Rhyner | 281/5 X |

*Primary Examiner*—Kenneth J. Dorner
*Assistant Examiner*—Cassandra L. Hope
*Attorney, Agent, or Firm*—Malcolm B. Wittenberg

[57] ABSTRACT

A sign system for conveying merchandise identifying and pricing information. A frame is provided having viewing regions for supporting and displaying information. Contained within at least one of the viewing regions are alphameric or numeric symbols which are contained on longitudinally extending strips of polymeric material which are characterized as comprising score portion of two or more substantially parallel extending cuts which pass through a substantial but not total thickness of the strip. Alphameric or numeric symbols which are not to be viewed are hidden behind those which are to be viewed by folding the vertically extending strip along the score portion.

10 Claims, 1 Drawing Sheet

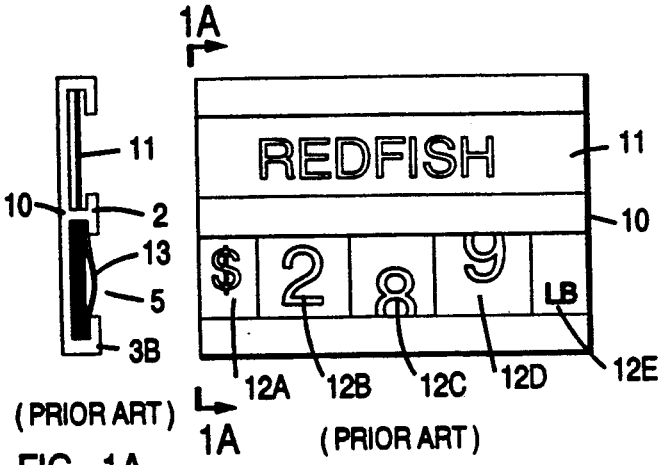
(PRIOR ART)
FIG. 1A
(PRIOR ART)
FIG. 1
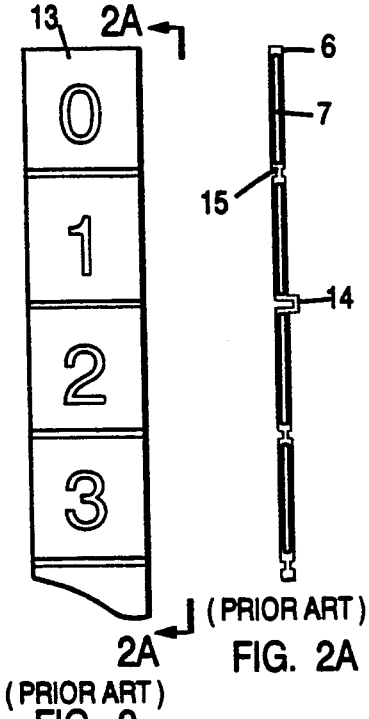
(PRIOR ART)
FIG. 2
(PRIOR ART)
FIG. 2A
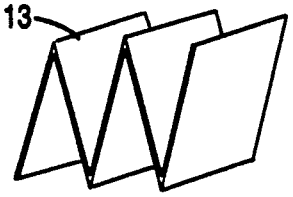
(PRIOR ART)
FIG. 3A
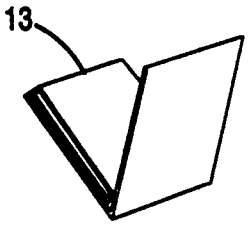
(PRIOR ART)
FIG. 3B
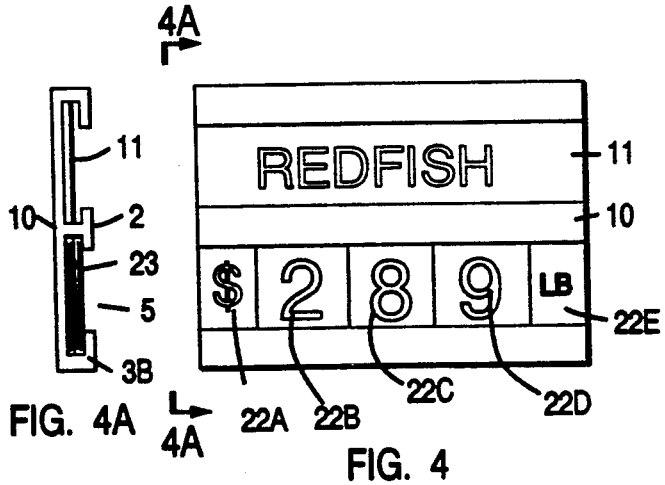
FIG. 4A
FIG. 4
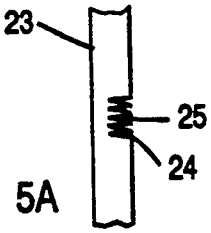
FIG. 5A
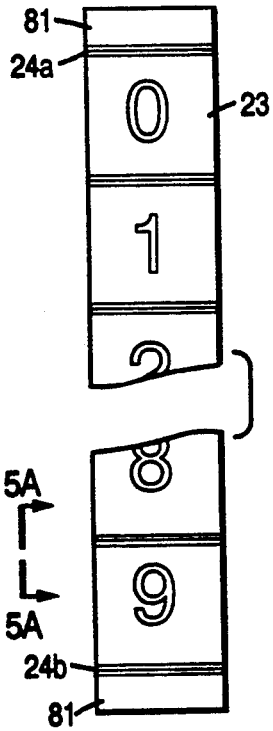
FIG. 5

SIGN SYSTEM

RELATED APPLICATIONS

The present application is a continuation-in-part of U.S. Application Ser. No. 07/554146 filed on Jul. 16, 1990.

TECHNICAL FIELD OF INVENTION

The present invention deals with a sign system for displaying alphanumeric information. Systems of this type are generally used in supermarkets and other retail environments whereby customers must be apprised of the identity and pricing of a variety of products. Product identifying information as well as its pricing are changed often in such environments and a quick and convenient system for not only displaying such information but constantly changing it is a necessity.

BACKGROUND OF THE INVENTION

There are a wide variety of sign systems employed in supermarkets and similar environments. All of these systems have, as a common factor, the ability to readily change the product identifying information for such information is constantly being updated, often times, more than once in a given working day. Even though a single sign may always be used in conjunction with a single product, product pricing can vary constantly. As a consequence, store clerks must be in a position to readily access a sign system and change its alphameric or numeric information without undue hardship. Further, it is certainly a goal to perform this function while maintaining the sign in an orderly well kept manner.

FIG. 1 shows a typical prior sign system of which the present invention is intended to improve upon. Such frame or holder 10 is provided with viewing region 11 which displays the product associated with the sign. In conjunction with product identifying information, numerical pricing information is shown in viewing region 5 (FIG. 1A) where the strips of FIG. 2 are folded and slipped in the channel created by overhangs 2 and 3B as elements 12A, 12B, 12C, 12D and 12E. In this particular case, the consumer would be embodied With the knowledge that the product "REDFISH" was being sold for $2.89 per pound.

The numeric information would be provided to frame 10 by vertically extending strips shown as element 13 of FIG. 2. In order to display the appropriate price of FIG. 1, the store clerk would fold strip 13 along horizontally extending fold lines 15 until five strips were at hand, the first displaying the symbol $, the second the numeral 2, the third numeral 8, the fourth the numeral 9 and the last the 1*b*. symbol. Once the fold is made along fold line 15, it assumes the shape shown as element 14 of FIG. 2A noting that typical prior art strips within plastic coating 6. In between the paper segment 7 is polymer web which displays a smaller cross sectional profile as shown in FIG. 2A. Strip 13 can be folded either in "accordion" style (FIG. 3A) or as "roll-up" configuration or a combination of each (FIG. 3B). These plastic over paper laminates are quite expensive to produce and, as noted below, they are not ideally suited for use in this environment.

Difficulties arise when the store clerk attempts to fold prior art laminate strips 13 and insert them within frame 10. In folding the vertically extending strips to reveal but a single numeral, it is quite difficult and almost impossible to bend strip 13 along fold lines 14 to ensure accurate horizontal region 5 (FIG. 1A). As shown in FIG. 1, misalignment of these numerals results in a display which can be characterized, at best, as a haphazard rather unprofessional product. Lack of alignment of the pricing numerals is something which even the casual observer would focus upon.

Although there are several contributing factors causing misalignment, certainly a principal factor is the result of employing strips as shown in FIG. 1A. Such strips are generally of a laminate construction which are provided with a single web or fold location 15. When a fold is made along web 15, the laminate sections being thicker in cross section than the web section tend to interfere with a smooth fold and cause the strip to "bow" as shown in area 5 held in place by channel forming regions 2 and 3B. This obviously adds a third dimension to the folded composite. Although the non-laminate strips of the present invention may also exhibit some misalignment, generally, "bowing" is reduced and, as previously noted, strip costs are greatly reduced in the elimination of laminates.

It is thus an object of the present invention to provide a sign system for conveying merchandise identifying and pricing information which is far less expensive than the prior art and exhibits fewer of the deficiencies recited above.

It is yet a further object of the present invention to provide a sign system for conveying merchandise identifying and pricing information which avoids the prior art tendency to use laminates.

These and further objects of the present invention will be more readily apparent when considering the following disclosure and appended drawings wherein FIGS. 1, 1A, 2, 2A, 3A and 3B depict prior sign systems currently practiced;

FIGS. 4 and 4A show systems which employ the strips of FIGS. 5 and 5A and;

FIGS. 5 and 5A show vertically extending strips for use in practicing the present invention.

SUMMARY OF THE INVENTION

The present invention deals with sign systems for conveying merchandise identifying and pricing information which comprises a frame having viewing regions for supporting and displaying said information. Contained within at least one of the viewing regions is alphameric or numeric symbols which are contained on a longitudinally extending strip. The alphameric and numeric symbols which are not to be viewed are hidden behind those which are to be viewed by folding the longitudinally extending strip along lines which are characterized as comprising two or more substantially parallel extending cuts which pass through a substantial but not total thickness of said longitudinally extending strip.

DETAILED DESCRIPTION OF THE INVENTION

Previous reference has been made to FIGS. 1, 1A, 2, 2A, 3A and 3B which typify prior art designs. The combination of providing vertically extending laminates 13 having horizontal fold lines 15 which deform as element 14 (FIG. 2A) result in a pricing misalignment and "bowing" as depicted in FIGS. 1 and 1A.

The same basic sign frame of the prior art can be employed in the present invention as shown in FIG. 4 as element 10. In this regard, sign portion 11 which currently reads "Redfish" as product identifying information is slipped within frame 10 as shown (FIG. 4A). However, the present invention represents a product which matches or exceeds the prior art laminates at a far lower cost by providing polymeric longitudinally extending strip 23 having score means 24. It has been found that regardless of the folding pattern, panels displayed by folding strip 23 along score means 24 produces a product exhibiting less "bowing" and which is less expensive to produce than laminates. In addition, the alignment of elements 22A, 22B, 22C and 22D (FIG. 4) is no worse and can even be better than shown in FIG. 1 by practicing the present invention. The present invention primarily differs from the prior art by providing horizontal score means 24 comprised of two or more substantially parallel horizontally extending cuts 25 which pass through a substantial but not total thickness of strip 23 of polymeric material.

Ideally, as a preferred embodiment, vertically extending strip 23 is comprised of a continuous polymeric material which has been printed with the alphameric or numeric information desired. As shown in FIG. 5, the polymeric material is separated by multiple horizontal cuts 25 which, preferably, extend about half way into the thickness of strip 23 which, ideally, can comprise a sheet of polypropylene approximately 0.010 inches in thickness. Further, ideally, horizontal cuts 25 are each approximately 0.010 to 0.012 inches from center to center.

The score means as shown in FIG. 5A, which are ideally six in number, greatly enhance the ability of the folded strip 23 to lay substantially flat with each segment substantially parallel to each adjacent segment as shown in FIG. 4A. As contrasted to the fold arrangement of FIG. 2A, the arrangement shown in FIG. 5A substantially reduces or completely eliminates the "bowing" affect as shown in FIG. 1A. This "bowing" adds a third dimension to each sign strip which detracts from the cleanliness and true horizontal alignment of any sign system.

It has further been contemplated, as yet a further preferred embodiment that at either one or both extremities of said vertically extending strip beyond the last of each set of horizontally extending score means 24A and 24B is provided end flaps 81 and 82 Which are free of any alphanumeric information. These blank panels when folded along horizontal score means 24A and 24B provide a neater presentation by eliminating a cut edge from appearing within frame 10 in the event that the extreme most panels containing the alphanumeric information is selected for display.

What is claimed is:

1. A sign system for conveying merchandise identifying and pricing information comprising a frame having viewing regions for supporting and displaying said information for contained within at least one of said viewing regions are alphameric panels or numeric panels having thereon, said panels comprise a longitudinally extending strip of polymeric material whereby said panels in a parallel which are not to be viewed are hidden in a parallel relationship behind those which are to be viewed by folding said longitudinally extending strip along score means created between at least two of said panels wherein each score means comprises at least two substantially parallel adjacent horizontally extending cuts which pass through a substantial but not total thickness of said strip on one face thereof.

2. The sign system of claim 1 wherein said strip comprises a continuous polymeric material displaying said alphameric or numeric symbols.

3. The sign system of claim 2 wherein said cuts are made approximately half way through the thickness of said polymeric material.

4. The sign system of claim 2 wherein said polymeric material is approximately 0.010 inches in thickness.

5. The sign system of claim 2 wherein said polymeric material is comprises polypropylene.

6. The sign system of claim 1 wherein said horizontal cuts are approximately 0.010 to 0.012 inches from center to center.

7. A sign system for conveying merchandise identifying and pricing information comprising a frame having viewing regions for supporting and displaying such information and contained within at least one of said viewing regions are panels having thereon, said panels comprise alphameric or numeric symbols a vertically extending strip of polymeric material having a thickness of approximately 0.010 inches whereby said panels in a parallel which are not to be viewed are hidden relationship behind those which are to be viewed by folding said vertically extending strip along horizontal score means which extend approximately halfway through the thickness of said polymeric material between said panels where each score means is disposed between at least two panels and comprises two parallel adjacent cuts formed on one face of the strip.

8. The sign system of claim 7 wherein said polymeric material comprises polypropylene.

9. The sign system of claim 7 wherein said horizontal cuts are approximately 0.010 to 0.012 inches apart.

10. The sign system of claim 7 wherein at least one extremity of said vertically extending strip beyond at least one of the extreme most horizontally extending horizontal score means are positioned end flaps which represent blank panels of said vertically extending strip.

* * * * *